United States Patent [19]

Holsten

[11] 4,003,781

[45] Jan. 18, 1977

[54] TAPING GUN

[76] Inventor: Roger W. Holsten, 1012 W. 10th St., North Platte, Nebr. 69101

[22] Filed: May 5, 1976

[21] Appl. No.: 683,255

[52] U.S. Cl. ..... 156/526; 156/575

[51] Int. Cl.[2] ..... B32B 31/00

[58] Field of Search ..... 156/574, 575, 576, 577, 156/579, 523, 524, 526

[56] References Cited

UNITED STATES PATENTS

| | | | |
|---|---|---|---|
| 2,328,571 | 9/1943 | Meyer | 156/526 |
| 2,405,742 | 8/1946 | Fulfer | 156/575 |
| 3,404,060 | 10/1968 | Taylor | 156/575 |
| 3,880,701 | 4/1975 | Moree | 156/575 |
| 3,960,643 | 6/1976 | Dargitz | 156/575 |

*Primary Examiner*—Douglas J. Drummond
*Attorney, Agent, or Firm*—Zarley, McKee, Thomte, Voorhees & Sease

[57] ABSTRACT

A taping gun or tool for dispensing tape for drywall or the like comprising a handle-like support means having a container mounted thereon adapted to receive a cement material therein. The container is provided with a first tape opening formed therein adjacent the juncture of the rearward and top walls thereof and has a second tape opening formed therein at the juncture of the front and top walls. A roll of tape is rotatably mounted on the support at the rearward end thereof and extends through the first tape opening and thence along the interior surfaces of the container rear wall, bottom wall, forward and thence outwardly through the second tape opening. A first roller is rotatably mounted on the forward end of the container and is adapted to receive the tape extending therearound to enable the roller to apply the tape having cement thereon to the drywall or the like. A tape cutter assembly is pivotally mounted on the forward end of the container and is movable from a tape cutting position to a non-cutting position. A spring is operatively connected to the tape cutter assembly for maintaining the assembly in its cutting position. An elongated flexible member is also secured to the tape cutter assembly to enable the operator to selectively maintain the tape cutter assembly in its non-cutting position. An elongated flat flexible member also extends through the interior of the container and is manually movable to permit pressure to be exerted on the tape towards the cement in the container.

11 Claims, 7 Drawing Figures

TAPING GUN

BACKGROUND OF THE INVENTION

This invention relates to a taping gun or tool and more particularly to a taping tool which may be employed in dispensing tape for use on "drywall".

The joints in drywall construction must be taped prior to the drywall being plastered, painted, texturized, etc. Ordinaarily, a layer of joint compound or cement is applied over the joint and the tape embedded therein. A second coat or layer of cement if ordinarily applied over the tape as required.

Taping guns have been previously provided and generally comprise a large floor mounted apparatus which dispenses joint tape having the joint cement applied thereto. The floor mounted apparatuses are difficult to use since several separate operations are required to replace the cement of the tape and then to place the tape on the wall. Further, the conventional floor mounted taping guns are extremely expensive and are difficult to maintain.

Some attempts have been made to provide a hand held taping gun but the hand held taping guns of which applicant has knowledge are extremely cumbersome and are difficult to operate by anyone other than an extremely skilled person. Additionally, the hand held taping guns of which applicant has knowledge ordinarily sever the tape closely adjacent the cement container which means that the operator must attempt to extract the leading edge of the tape for subsequent operations and such attempts are time consuming and difficult.

Further, the previous hand held taping guns do not have any convenient means for urging the tape in the cement container towards the cement so that the cement will be evenly distributed on the tape.

Therefore, it is a principal object of the invention to provide an improved taping gun.

A further object of the invention is to provide a taping gun which permits joint tape to be dispensed having the joint cement or compound applied thereto.

A further object of the invention is to provide a taping gun which may be either hand held in either the right hand or the left hand of the operator.

A further object of the invention is to provide a taping gun which has a tape cutter assembly pivotally mounted thereon which automatically cuts the tape.

A still further object of the invention is to provide a taping gun having means thereon for efficiently applying the cement to the tape.

A still further object of the invention is to provide a taping gun which is economical to manufacture, durable in use and refined in appearance.

DESCRIPTION OF THE PREFERRED EMBODIMENT

Figure 1:
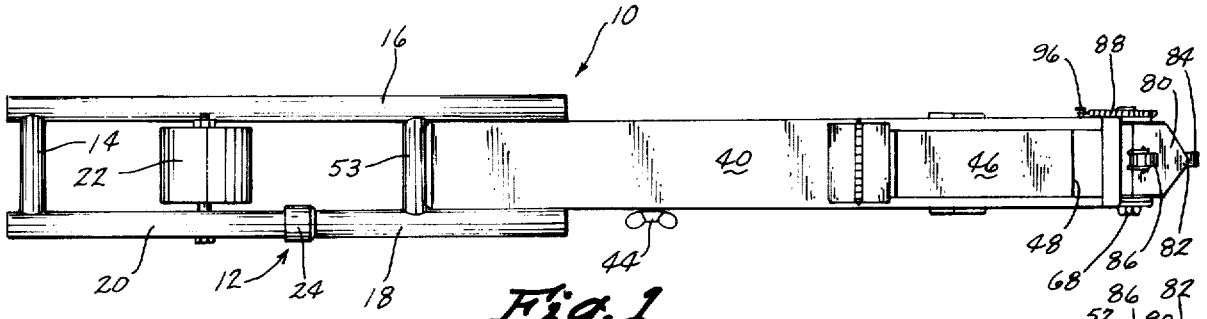
FIG. 1 is a top view of the gun.
Figure 2:
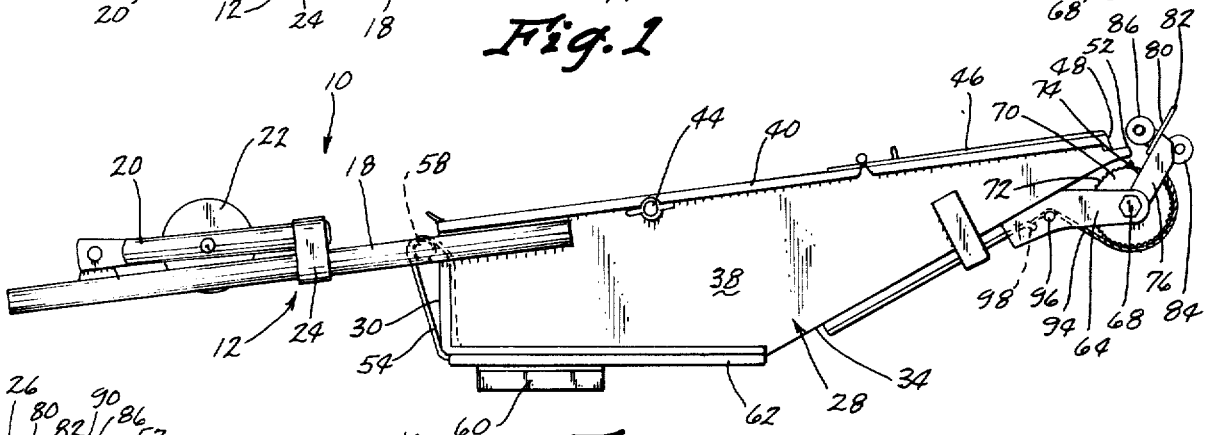
FIG. 2 is a side view of the gun.
Figure 3:
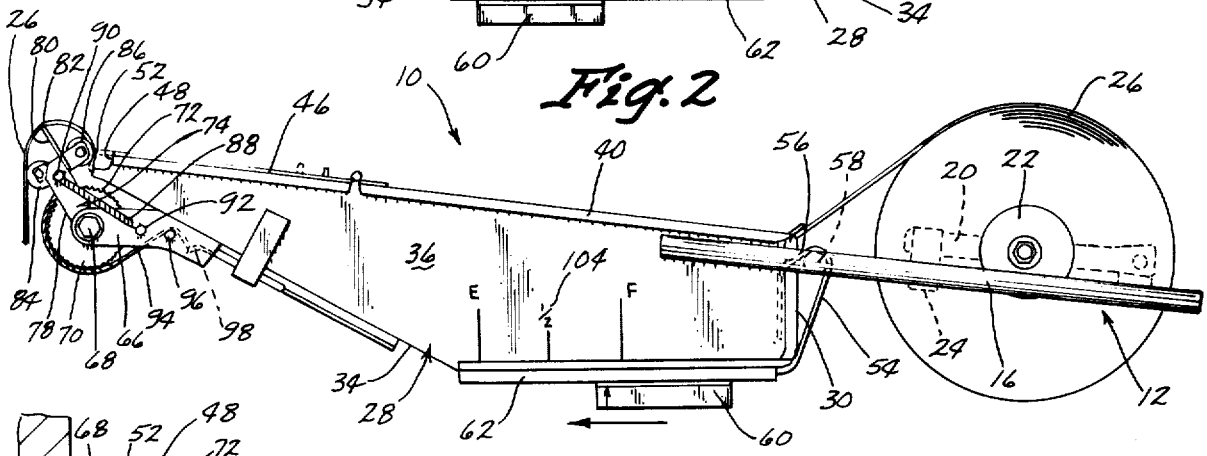
FIG. 3 is a side view of the gun as seen from the opposite side of FIG. 2.
Figure 4:
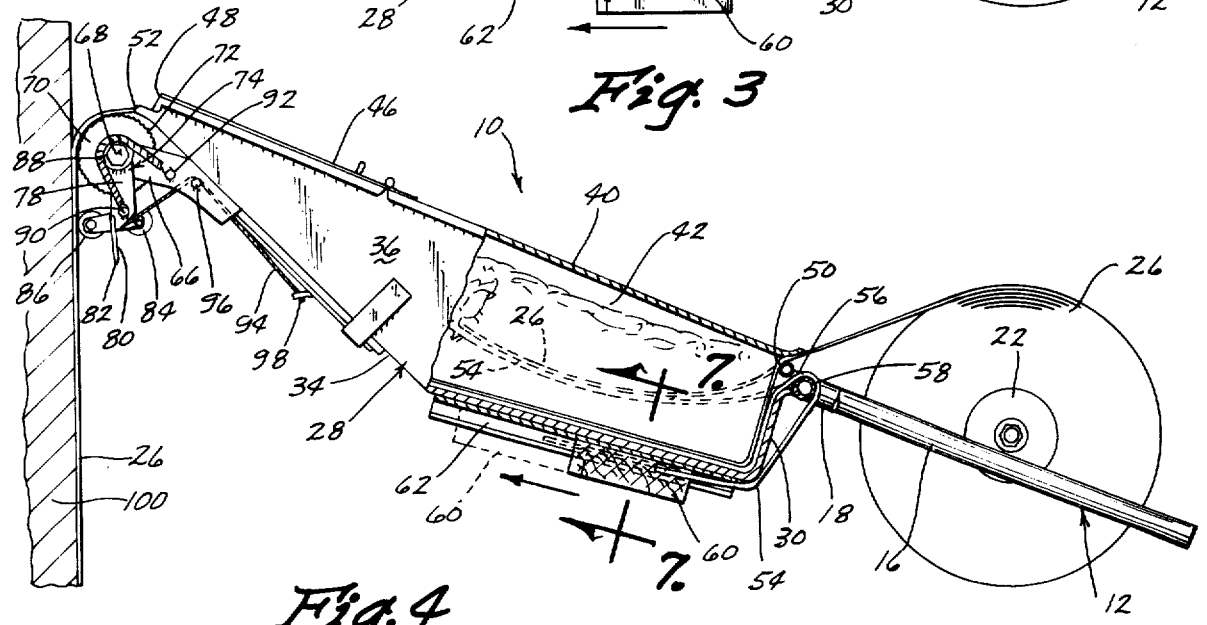
FIG. 4 is a side view of the gun illustrating the tape being applied to a wall with portions of the gun cut away to more fully illustrate the invention.

The numeral 10 refers generally to the taping gun or tool of this invention. Gun 10 is provided with a U-shaped handle or support 12 at its rearward end. Handle 12 comprises a base portion 14 and depending legs 16 and 18. Arm 20 is pivotally secured at one end to leg 18 and is movable between a loading position and the operative position seen in the drawings. Cylinder 22 is rotatably mounted on arm 20 and has a width less than the distance between legs 16 and 18 so that it may be partially received therebetween as also illustrated in the drawings. Retainer 24 is slidably mounted on arm 16 and is adapted to slidably extend over the forward end of arm 20 to maintain the arm 20 in the operative position of FIG. 2. The numeral 26 refers to roll of joint tape material which is mounted on the cylinder 22 and which extends forwardly therefrom as illustrated in FIGS. 3 and 4. The numeral 28 refers generally to a cement container or housing which is secured to handle 12 and which extends forwardly therefrom. Container 28 comprises a rear wall 30, bottom wall 32, front wall 34, opposite side walls 36 and 38 and a top wall or cover 40 which is pivotally mounted thereon. Cover 40 may be pivotally opened from the position of FIG. 4 to permit the placement of cement 42 in the container 28 or maintained in the closed position of FIG. 2 by wing nut assembly 44. The numeral 46 refers to an auxiliary tape cutting knife having a leading cutting edge 48 and which is slidably movable from the position of FIG. 2 to an extended position so that the leading edge will be positioned forwardly of the container to permit tape to be severed as desired.

Container 28 is provided with a tape opening 50 formed therein adjacent the juncture of the upper end of rear wall 30 and the rearward end of top wall 40. Container 28 is also provided with a tape opening 52 formed therein adjacent the juncture of the forward end of forward wall 34 and the forward end of top wall 40. The numeral 54 refers to an elongated flat flexible member having its forward end secured to container 28 adjacent the opening 52 and which extends rearwardly therefrom as illustrated in the drawings. As seen, flexible member 54 extends rearwardly in container 28 from opening 52 and is normally positioned adjacent the interior surface of forward wall 34, bottom wall 32 and rear wall 30. Flexible member 54 extends outwardly through opening 56 formed in rear wall 30 and extends over a roller 58 secured to and extending between legs 16 and 18. A slide 60 is slidably mounted on a channel member 62 secured to the exterior surface of bottom wall 32 and is movable rearwardly and forwardly as depicted in FIG. 4. The end of flexible member 54 is secured to slide 60 so that forward movement of the slide 60 relative to container 28 causes the flexible member 54 to move upwardly within the container 28 as will be described in more detail hereinafter.

A pair of supports 64 and 66 are secured to container 28 adjacent the forward end thereof and extend forwardly therefrom in a spaced-apart relationship. Bolt 68 is secured to and extends between the supports 64 and 66 and has a roller 70 rotatably mounted thereon. Roller 70 is provided with an irregular peripheral surface referred to generally by the reference numeral 72 for facilitating the gripping of the tape by the roller 70.

The numeral 74 refers generally to a tape cutter assembly comprising arms 76 and 78 which are pivotally mounted on the bolt 68 and which extend therefrom. Blade 80 is provided at the outer ends of the arms 76 and 78 and is provided with a point 82. Rollers 84 and 86 are rotatably mounted on the tape cutter assembly on opposite sides of the blade 80 as seen in FIGS. 2–4. Spring 88 is secured at one end to screw 90 which is secured to arm 78 and is secured at its other end to screw 92 mounted on support 66. Spring 88 normally maintains the tape cutter assembly 74 in the position illustrated in FIG. 3. A flexible member such as a cable 94 is secured to tape cutter assembly adjacent the forward end thereof and extends rearwardly therefrom over post of pin 96 and is connected at its rearward end to a manually movable slide assembly 98 which is slidably mounted on the exterior surface of forward wall 34. Thus, rearward slidable movement of the slide 98 causes the tape cutter assembly 74 to be pivotally moved from the position of FIG. 3 to the position of FIG. 4. The slide 98 facilitates the initial placement of the tape cutter assembly in the position of FIG. 4.

Figure 5:
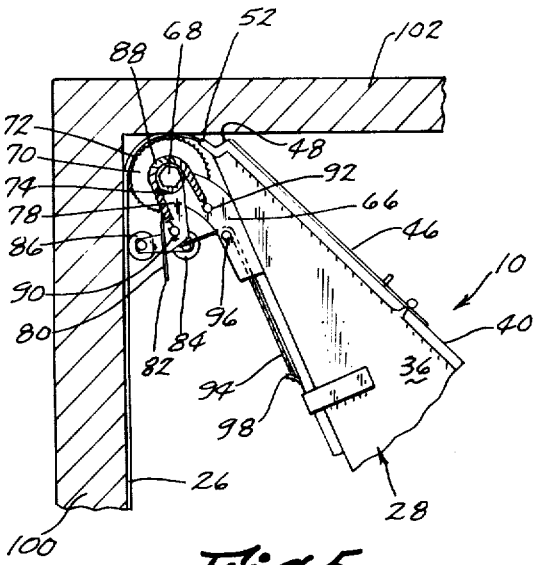
FIG. 5 is a partial side view illustrating the manner in which the gun is operated to apply tape.
Figure 6:
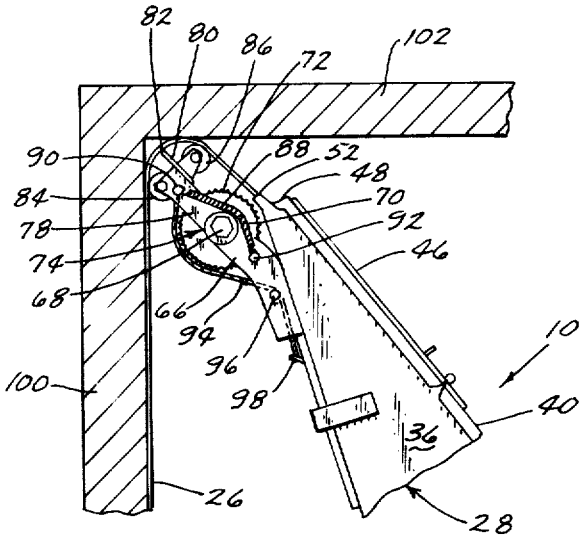
FIG. 6 is a view similar to FIG. 5 except that the tape is being cut.
Figure 7:
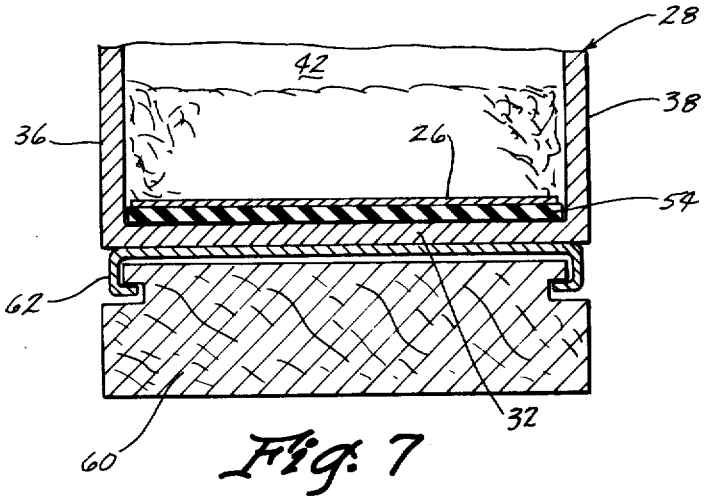
FIG. 7 is an enlarged sectional view as seen on lines 7—7 of FIG. 4.

In operation, top wall 40 would be opened to facilitate the insertion of the tape 26 through the container 28 as previously described. Ordinarily, the slide 60 would be in the rearward position so that the flexible member 54 was closely adjacent the interior surfaces of rear wall 30, bottom wall 32 and forward wall 30. The cement 42 is then placed in the container and the top wall 40 closed as previously described. Initially, slide 98 is slidably moved rearwardly on forward wall 34 to cause the tape cutter assembly 74 to be pivotally moved to the position of FIG. 4. The leading edge of the tape 26 would then be extended around the periphery of the roller 70 and placed into engagement with the wall 100 such as in the manner illustrated in FIG. 4. The slide 98 may then be released which causes the roller 86 to be moved into engagement with the tape on the wall which prevents the blade 80 from moving into contact with the tape as the tool is being moved upwardly along the wall. Upward movement of the gun along the wall causes the tape to be pulled from the tape roll and passed through the interior of the container 40 where a coating of cement is applied thereto. The gripping surface on the roller 70 causes the tape to be maintained in engagement with the wall and prevents slippage therebetween. FIGS. 5 and 6 illustrate the manner in which the tape is severed at the upper end of the wall. The tool 10 is moved upwardly along the wall 100 until the roller 55 is substantially in the corner defined by the wall 100 and the ceiling 102. When the position of FIG. 5 has been reached, the tool 10 is lowered slightly and moved outwardly with respect to the wall. The outward movement of the tool 10 with respect to the wall 100 permits the spring 88 to pivotally move the cutter assembly upwardly in a clockwise direction as viewed in FIG. 5 thereby bring the blade 80 into cutting engagement with the tape 26 to sever the same. With the tape severed, the tool may be removed and the upper end of the tape 26 may be manually pressed into place.

An important feature of the gun is that the blade 80 severs the tape a substantial distance from the opening 52 which means that a substantial length of the tape 26 remains exposed from the container after the tape has been severed. Where it is desired to apply another strip of tape to the wall, the slide 98 is again moved rearwardly with respect to the device so that the tape cutter assembly 74 is again moved to the position of FIG. 4. The exposed strip of tape which extends from opening 72 will extend adjacent a portion of the roller 70 which permits the tape to again be moved into contact with the wall without the need for manually pulling the tape from the container.

Another important feature of the device is the flexible member 54 and its control by the slide 60. As the cement is consumed, the slide 60 is manually urged forwardly relative to wall 32 which causes the flexible member 54 in the container 28 to be moved upwardly thereby urging the tape 26 resting thereon to be moved upwardly into engagement with the cement. Such a feature insures that the tape will always be maintained in contact with the cement in the container. Additionally, the container 28 is provided with indicia referred to generally by the reference numeral 104 which indicates to the operator the amount of cement remaining in the container.

Thus it can be seen that a novel taping tool has been provided which accomplishes at least all of its stated objectives.

I claim:

1. A tapping tool comprising, a support means having rearward and forward ends, a container mounted on said support means adapted to receive a cement material therein, said container having a rearward wall, a forward wall, spaced apart side walls, a bottom wall and a closable top wall, said container having a first tape opening formed therein between rearward wall and said top wall, said container having a second tape opening formed therein between said front wall and said top wall, means for supporting a roll of tape material on said support means adjacent the rearward end thereof so that said tape material may pass into said container through said first opening, thence adjacent said rearward wall, thence adjacent said bottom wall, thence adjacent said forward wall, thence outwardly through said second opening, said cement material in said container being normally positioned above said tape material so that a layer of cement material is placed on said tape material as said tape material is pulled through said container, a first roller means operatively rotatably mounted at the forward end of said container adapted to have the tape material with cement thereon pass at least partially therearound and onto a wall surface as the tape material is applied thereto, and a tape cutter assembly pivotally mounted at the forward end of said container adjacent said first roller, said tape cutter assembly being movable between a first non-cutting position to a second cutting position, said tape cutter assembly having a blade mounted thereon, means normally yieldably urging said tape cutter assembly to its said cutting position, and means on said tape cutter assembly for selectively maintaining said blade out of engagement with the tape material when said tape material is being applied to the wall surface.

2. The tool of claim 1 wherein said means on said tape cutter assembly comprises a flexible member secured at one end thereof to said tape cutter assembly and extending therefrom, a slide member movably mounted on said container and having the other end of said flexible member secured thereto.

3. The tool of claim 2 wherein said means on said tape cutter assembly also comprises a second roller rotatably mounted on said blade.

4. The tool of claim 3 wherein said second roller also comprises a tape material creasing member.

5. The tool of claim 3 wherein a third roller is mounted on said blade opposite to said second roller.

6. The tool of claim 1 wherein an auxiliary tape material cutter blade is slidably mounted on said top wall and has a cutting edge positioned adjacent said second tape opening, said auxiliary cutting blade being slidably movable from a stored position to a cutting position.

7. The tool of claim 1 wherein said first roller means comprises a drum member having tape gripping means provided on the periphery thereof.

8. The tool of claim 1 wherein said roller means and said tape cutter assembly have common rotational and pivotal axes.

9. The tool of claim 1 wherein said means normally yieldably urging said tape cutting assembly to its said cutting position comprises a spring means.

10. The tool of claim 1 wherein an elongated flat flexible member is secured at one end to said container adjacent said second opening and extends therefrom adjacent said forward wall, thence adjacent said bottom wall, thence adjacent said rearward wall and thence outwardly from said container, thence adjacent the exterior surface of said rearward wall, thence adjacent the exterior surface of said bottom wall, said tape material in said container normally being positioned between said flat flexible member and said cement material, and slide connection means secured to the other end of said flat flexible member and being operatively slidably mounted on said container whereby slidable movement of said slide connection means in a forwardly direction relative to said container will cause said flat flexible member to urge said tape material in said container into engagement with the cement material in said container.

11. The tool of claim 10 wherein said flat flexible member has a width substantially equal to said tape material and said container.

* * * * *